US009297131B2

(12) United States Patent
Bullington et al.

(10) Patent No.: US 9,297,131 B2
(45) Date of Patent: Mar. 29, 2016

(54) TRAILING SHIELD FOR A SNOW REMOVAL DEVICE

(75) Inventors: Shawn Bullington, Huntersville, NC (US); Mark Holloway, Evans, GA (US)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 14/238,027

(22) PCT Filed: Aug. 31, 2011

(86) PCT No.: PCT/US2011/049896

§ 371 (c)(1),
(2), (4) Date: Feb. 10, 2014

(87) PCT Pub. No.: WO2013/032457

PCT Pub. Date: Mar. 7, 2013

(65) Prior Publication Data

US 2014/0196323 A1 Jul. 17, 2014

(51) Int. Cl.

| | |
|---|---|
| ***E01H 5/09*** | (2006.01) |
| *E01H 5/04* | (2006.01) |
| *E01H 5/06* | (2006.01) |

(52) U.S. Cl.

CPC ..... *E01H 5/098* (2013.01); *E01H 5/045* (2013.01); *E01H 5/061* (2013.01)

(58) Field of Classification Search

CPC ..... E01H 5/04; E01H 5/065; E01H 5/066; E01H 5/098; E01H 5/063; E01H 5/09; E01H 5/08; E01H 5/061; E01H 5/062

USPC ..... 37/253, 254, 257

See application file for complete search history.

(56) References Cited

U.S. PATENT DOCUMENTS

| | | | | |
|---|---|---|---|---|
| 2,936,537 | A | 5/1960 | Bain | |
| 3,126,652 | A * | 3/1964 | Reissinger | 37/233 |

(Continued)

FOREIGN PATENT DOCUMENTS

| | | | |
|---|---|---|---|
| CH | 481274 | A | 8/1968 |
| EP | 2495368 | A1 | 9/2012 |

(Continued)

OTHER PUBLICATIONS

Chapter 1 of the International Preliminary Report on Patentability of PCT/US2011/049896 issued on Mar. 4, 2014, all enclosed pages cited.

(Continued)

*Primary Examiner* — Thomas B Will
*Assistant Examiner* — Joan D Misa
(74) *Attorney, Agent, or Firm* — Nelson Mullins Riley & Scarborough LLP

(57) ABSTRACT

A snow removal device may include an auger assembly, a mobility assembly, a housing and a blowback prevention assembly. The auger assembly may include a rotatable auger that imparts momentum to draw material engaged by the auger toward an ejection path. The auger may extend substantially transversely with respect to a front portion of the snow removal device. The mobility assembly may be configured to enable the snow removal device to move with respect to a surface. The housing may be disposed proximate to a portion of the auger assembly to direct at least some of the material toward the ejection path responsive to rotation of the auger. The blowback prevention assembly may be disposed to inhibit blowback of material between the housing and the surface. The blowback prevention assembly may include a scraper bar and a trailing shield.

20 Claims, 5 Drawing Sheets

(56) References Cited

U.S. PATENT DOCUMENTS

| | | | | | |
|---|---|---|---|---|---|
| 3,334,429 | A * | 8/1967 | Price | | 37/243 |
| 3,465,456 | A * | 9/1969 | Meyer | | 37/233 |
| 3,468,041 | A * | 9/1969 | Mattson et al. | | 37/246 |
| 3,477,149 | A * | 11/1969 | Wagner | | 37/233 |
| 3,490,057 | A * | 1/1970 | Kahlbacher | | 37/245 |
| 4,294,027 | A | 10/1981 | Edwards | | |
| 4,709,492 | A * | 12/1987 | Watson | | 37/232 |
| 4,783,915 | A * | 11/1988 | Sasaki et al. | | 37/251 |
| 5,123,186 | A * | 6/1992 | Matushita et al. | | 37/251 |
| 5,140,763 | A * | 8/1992 | Nichols, IV | | 37/233 |
| 5,174,053 | A * | 12/1992 | Takeshita | | 37/258 |
| 5,410,825 | A * | 5/1995 | Perrelli | E01H 5/098 | 37/232 |
| 5,471,770 | A * | 12/1995 | Ferreira | | 37/264 |
| 5,819,443 | A * | 10/1998 | Winter | | 37/233 |
| 6,154,985 | A | 12/2000 | Champagne et al. | | |
| 6,163,986 | A | 12/2000 | Townsend | | |
| 6,256,910 | B1 * | 7/2001 | Grozde | | 37/266 |
| 6,618,965 | B1 * | 9/2003 | Schultz et al. | | 37/232 |
| 6,688,021 | B2 * | 2/2004 | Baig et al. | | 37/214 |
| 7,257,909 | B2 | 8/2007 | Shaffer et al. | | |
| 7,676,964 | B2 * | 3/2010 | Schmeichel | | 37/268 |
| 7,730,641 | B2 * | 6/2010 | Ruuska | E01H 5/062 | 172/816 |
| 7,730,643 | B2 * | 6/2010 | Mishra et al. | | 37/266 |
| 2002/0073581 | A1 | 6/2002 | Takeuchi | | |
| 2004/0148819 | A1 | 8/2004 | Hanafusa et al. | | |
| 2005/0241190 | A1 | 11/2005 | Kettering et al. | | |
| 2007/0271828 | A1 | 11/2007 | Mishra et al. | | |
| 2008/0244935 | A1 | 10/2008 | Crimmins | | |
| 2009/0307943 | A1 | 12/2009 | Buckbee et al. | | |

FOREIGN PATENT DOCUMENTS

| | | | |
|---|---|---|---|
| JP | 11256537 | A | 9/1999 |
| JP | 2005299159 | A | 10/2005 |

OTHER PUBLICATIONS

International Search Report and Written Opinion of PCT/US2011/049896 mailed Jan. 25, 2012, all enclosed pages cited.

* cited by examiner

TRAILING SHIELD FOR A SNOW REMOVAL DEVICE

TECHNICAL FIELD

Example embodiments generally relate to outdoor power equipment and, more particularly, relate to a trailing shield for employment with a device such as a snow removal device.

BACKGROUND

Grounds care/yard maintenance and other outdoor tasks associated with grooming and maintaining property are commonly performed using various tools and/or machines that are configured for the performance of corresponding specific tasks. Certain tasks, like snow removal, are typically performed by snow removal equipment such as snow blowers or snow throwers. The snow removal equipment may, in some cases, be walk-behind models. However, snow blower or snow thrower attachments can sometimes be added to lawn tractors or other riding yard maintenance vehicles as well.

Walk behind snow blowers or snow throwers may be single stage or dual stage snow removal devices. A single stage snow thrower may include a high speed auger blade that is rotated at the front of the snow thrower. The rotation of the auger blade may intake snow and impart momentum on the snow to eject the snow through a chute all in one stage of operation. A dual stage snow blower may add an additional stage by having the auger blade (e.g., the first stage) feed snow into an impeller (e.g., the second stage) that imparts momentum on the snow to eject the snow through a chute. In such an example, the first stage auger may operate at lower speeds since the impeller will provide a momentum boost for snow ejection.

Although the momentum imparted by the auger is meant to direct snow into the path for ejection via the chute, some of the snow that is initially forced rearward to be directed out the ejection chute may escape the intended ejection path and be ejected back toward the operator. This phenomenon may be referred to as blowback. The existence of blowback, although not harmful, may cause operators to be less satisfied with the performance of the snow removal device. To reduce the incidence of blowback, a scraper bar and housing are typically provided to inhibit snow from passing underneath the snow removal device and back toward the operator. However, operations over uneven surfaces, and even the small tolerances between the scraper bar and the ground, may allow some snow to be ejected back toward the operator in the form of blowback. The occurrence of the blowback can thus provide a negative impact on the operator experience.

BRIEF SUMMARY OF SOME EXAMPLES

Accordingly, in order to improve operator satisfaction in connection with using a snow removal device, some example embodiments may provide a trailing shield for a snow blower or snow thrower. The trailing shield may be attached proximate to the scraper bar, but provide an at least partially flexible material to assist in blocking material that passes under the scraper bar from passing completely under the snow blower or snow thrower and being noticed by the operator as blowback.

In one example embodiment, a snow removal device is provided. The snow removal device may include an auger assembly, a mobility assembly, a housing and a blowback prevention assembly. The auger assembly may include a rotatable auger that imparts momentum to draw material engaged by the auger toward an ejection path. The auger may extend substantially transversely with respect to a front portion of the snow removal device. The mobility assembly may be configured to enable the snow removal device to move with respect to a surface. The housing may be disposed proximate to a portion of the auger assembly to direct at least some of the material toward the ejection path responsive to rotation of the auger. The blowback prevention assembly may be disposed to inhibit blowback of material between the housing and the surface. The blowback prevention assembly may include a scraper bar and a trailing shield. The scraper bar may be disposed transversely with respect to a bottom portion of the snow removal device and proximate to the housing and the auger assembly. The trailing shield may be disposed proximate to the scraper bar and rearward of the scraper bar.

In another example embodiment, a blowback prevention assembly is provided. The blowback prevention assembly may be provided for inhibiting blowback on a snow removal device. The blowback prevention assembly may include a scraper bar and a trailing shield. The scraper bar may be disposed transversely with respect to a bottom portion of the snow removal device and proximate to an auger assembly and housing of the snow removal device. The auger assembly may include a rotatable auger that imparts momentum to draw material engaged by the auger toward an ejection path of the snow removal device. The auger may extend substantially transversely with respect to a front portion of the snow removal device. The housing may be disposed proximate to a portion of the auger assembly to direct at least some of the material toward the ejection path responsive to rotation of the auger. The trailing shield may be disposed proximate to the scraper bar and rearward of the scraper bar.

Some example embodiments may improve an operator's ability to obtain a clean snow removal operation without ejection of snow back toward the operator via an underside of a snow removal device. The user experience associated with operating the snow removal device may therefore be improved.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1A:
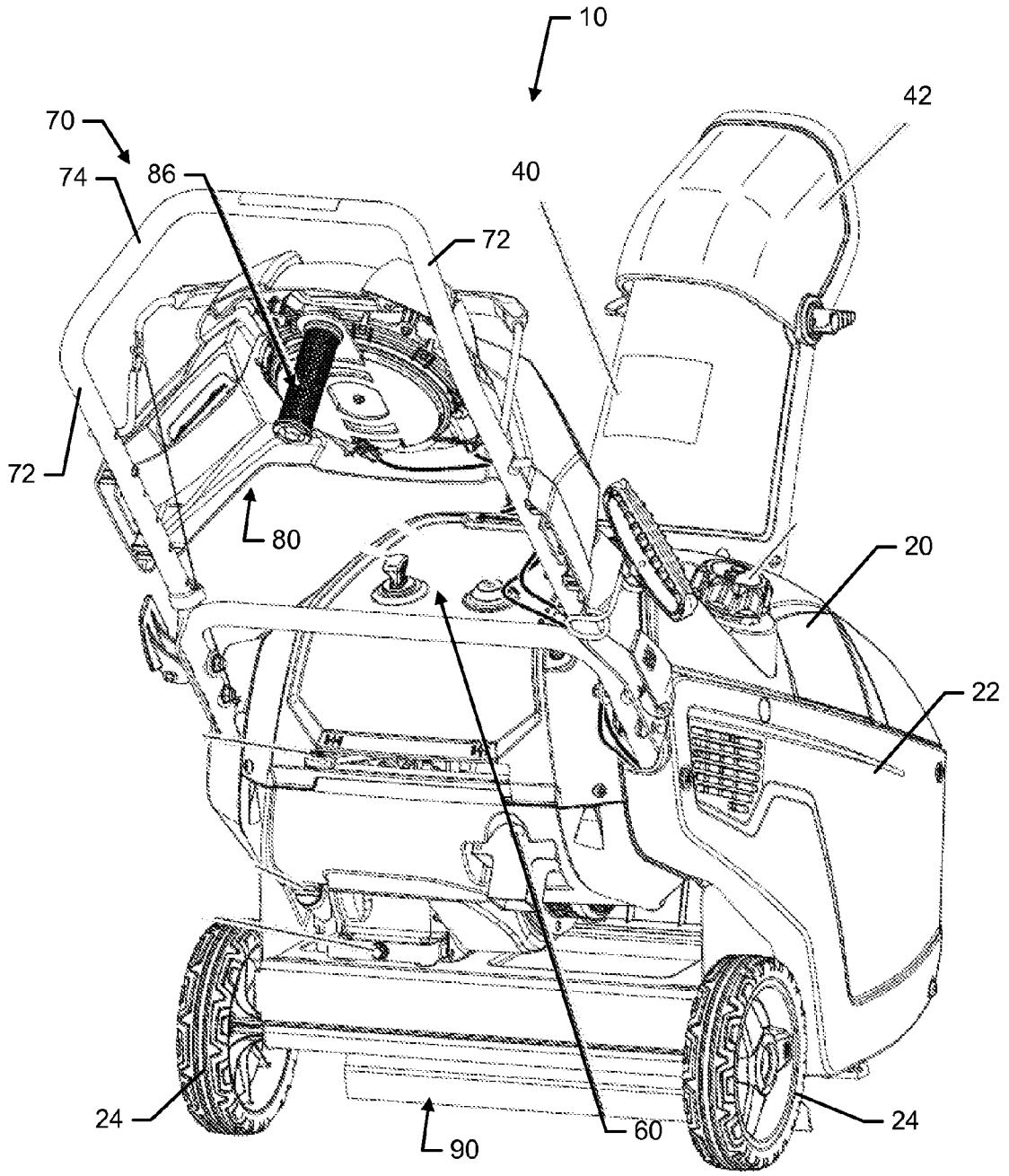
FIG. 1A illustrates a perspective view of the rear of the snow removal device according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure.

Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve an operator's experience associated with operating a snow removal device (e.g., a snow blower or snow thrower) generally by improving the snow removal device's ability to prevent blowback. In an example embodiment, a trailing shield may be provided proximate to a scraper bar of the snow removal device. The trailing shield may, in some cases, be provided rearward of the scraper bar and include a rigid portion that attaches to the scraper bar and a flexible portion (e.g., made of an elastomer) that maintains better contact with the surface over which the snow removal device passes. Since the flexible portion can flex with the surface, the trailing shield may improve the overall contact with the surface even over uneven ground. Moreover, in some cases, the flexible portion, which may be referred to as a skirt, may be preloaded to facilitate the exertion of a small amount of force downward onto the ground to further improve contact with the ground. The preloading of the skirt may be provided by an arcuate curvature that curves the skirt downward toward the surface or even slightly forward in some cases.

Figure 1B:
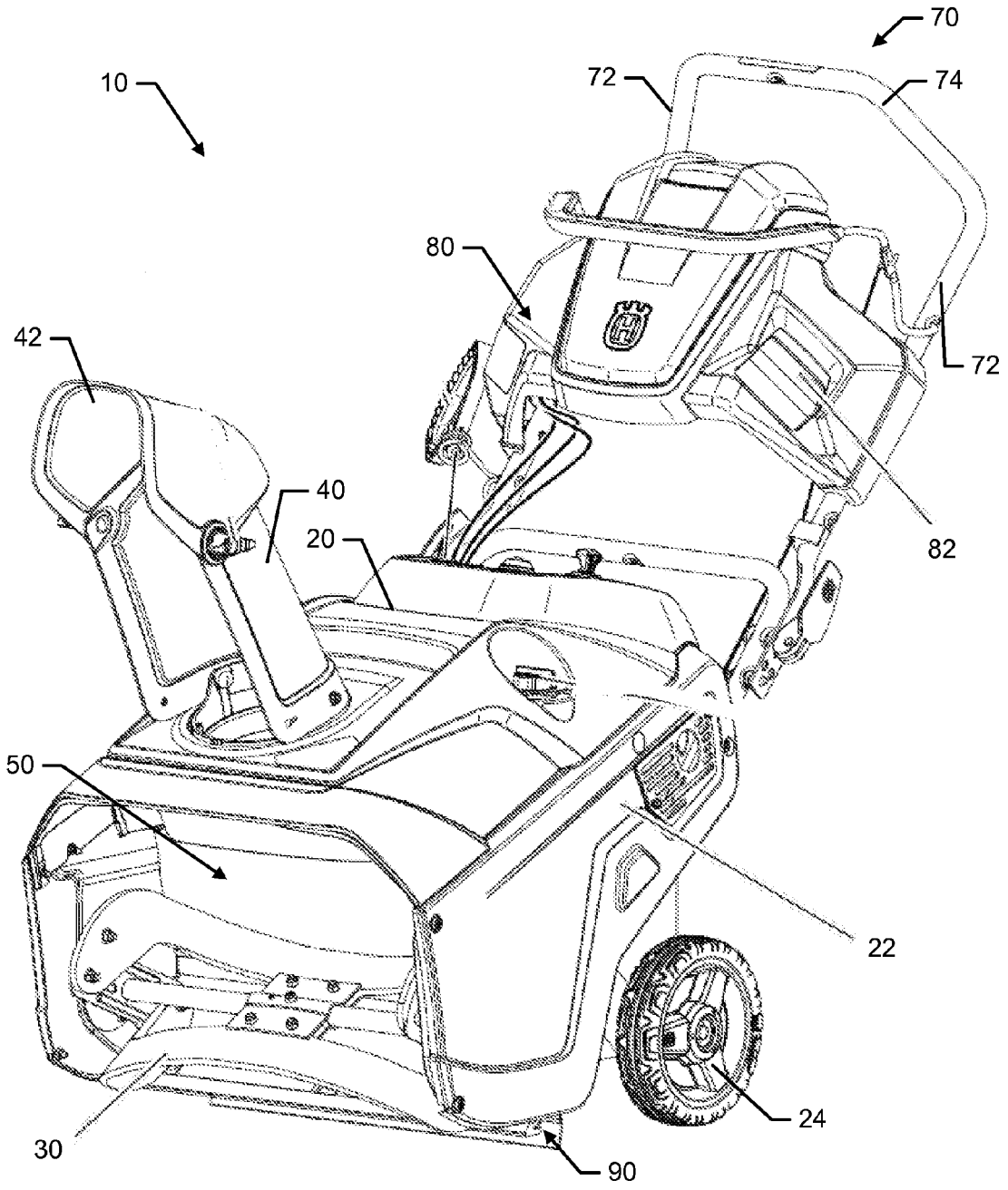
FIG. 1B illustrates a perspective view of the front of the snow removal device according to an example embodiment.

FIG. 1, which includes FIGS. 1A and 1B, illustrate a walk behind snow removal device removal device 10 according to an example embodiment. However, it should be appreciated that example embodiments may also be practiced in connection with any other device that may benefit from having a remote chute repositioning system. Thus, remote chute positioning for other than walk behind snow removal device models or devices that eject materials other than snow may also be provided in accordance with some example embodiments. FIG. 1A illustrates a perspective view of the rear of the snow removal device 10 according to an example embodiment. FIG. 1B illustrates a perspective view of the front of the snow removal device 10 according to an example embodiment.

In some embodiments, the snow removal device 10 may include a hood assembly 20. The hood assembly 20 may be either removable or rotatable to expose engine components and/or other snow removal device components. The hood assembly 20 may be configured to mate with side panels 22 between which engine components and/or ejection system components may be disposed. In some embodiments, the snow removal device 10 may include wheels 24 or continuous tracks forming a mobility assembly on which a substantial portion of the weight of the snow removal device 10 may rest, when the snow removal device 10 is operated. The wheels 24 or continuous tracks may also provide for mobility of the snow removal device 10. In this regard, for example, drive power may be selectably provided to the wheels 24 or continuous tracks in some cases from the engine.

The example shown in FIG. 1 is a single stage snow blower. Thus, the ejection system of this example includes an auger assembly configured to rotate an auger blade 30 providing momentum to material (e.g., snow) drawn in by the rotation of the auger blade 30 where the auger blade 30 provides the only stage for snow removal. When removing snow, the auger blade 30 may be operatively coupled to the engine of the snow removal device 10 such that the auger blade 30 may be selectively rotated about an axis that extends in a direction oriented between the side panels (and therefore parallel to the surface of the ground). In other words, the auger assembly extends transversely with respect to a front of the snow removal device 10. Snow may be drawn inwardly and then momentum provided by the auger blade 30 may cause the snow to be ejected through a discharge chute 40. It should be appreciated, however, that some example embodiments could also be used in connection with dual stage snow blowers in which the auger assembly may further include a second stage impeller for forcing the snow out of the discharge chute 40.

The discharge chute 40 may include a chute deflector 42 that may be adjusted up and down by the operator to control the height of the discharge stream of snow that is ejected via the discharge chute 40. In an example embodiment, the discharge chute 40 and the chute deflector 42 may be the last components in an ejection path through which snow may travel responsive to rotation of the auger blade 30. In some cases, the ejection path may include a housing 50 defined proximate to the auger assembly. The housing 50 may, in some cases, include side panels and a rear panel that combine to at least partially surround a portion of the auger assembly. As such, the housing 50 may be disposed between a portion of the side panels 22 and forward of the wheels 24, which may form a mobility assembly for providing movement of the snow removal device 10. When the auger blade 30 rotates, the rotation may generally be such that the auger blade 30 rotates forward as it passes through its range of motion at a point farthest away from the surface (e.g., the ground) on which the snow removal device 10 operates, and rotates toward the rear as it passes closest to the surface. Thus, the auger blade 30 may draw snow rearward and impart momentum on the snow to direct it toward the housing 50. The rear and side panels of the housing 50 may direct the snow toward the discharge chute 40 for ejection from the snow removal device 10.

In an example embodiment, the snow removal device 10 may further include a control panel 60, which may include ignition controls and/or other controls or informational gauges. The control panel 60 may be provided to be accessible from the rear of the snow removal device 10 by an operator standing or walking behind the snow removal device 10 (e.g., at an operator's station) and capable of pushing, steering or otherwise controlling movement of the snow removal device 10 using a handlebar assembly 70 or some other steering assembly. In some examples, the handlebar assembly 70 may include at least two arms 72 that may extend up and rearward away from the side panels 22 to provide a structure for an operator to hold to facilitate direction and operation of the snow removal device 10. The arms 72 may extend substantially parallel to each other and may be positioned to extend at an angle of between about 30 degrees to 60 degrees from the horizontal back toward an operator standing or walking behind the snow removal device 10 at the operator's station. In some cases, the arms 72 may include handles at the end of each respective one of the arms 72. The handles may include controls for snow removal device 10 operation in some cases. In an example embodiment, a cross bar 74 may extend between distal ends of the arms 72 to provide an additional hand rest option for the operator. The cross bar 74 may also provide support for the distal ends of the arms 72.

In some example embodiments, the snow removal device 10 may further include a console 80 disposed to extend between the arms 72. In some example embodiments, such as embodiments where separate handles are positioned at the ends of the arms 72, the console 80 may provide some degree of structural support for distal ends of the arms 72. Alternatively or additionally, the console 80 may provide a structure to which accessories or components of the snow removal device 10 may be added. For example, in some embodiments, the console 80 may provide a structure for supporting one or more lights 82. In an example embodiment, the console 80 may also provide a structure for supporting a control head 86 that may be used to position the discharge chute 40.

As shown in FIGS. 1A and 1B, the snow removal device 10 may further include a blowback prevention assembly 90. The blowback prevention assembly 90 may be disposed at an underside of the snow removal device 10 to inhibit the occurrence of blowback by providing improved contact with the surface over which the snow removal device 10 operates (e.g., the ground) as described in greater detail below. It should be appreciated that the term "blowback prevention" does not insinuate a complete elimination of blowback, or require that all blowback is prevented by the blowback prevention assembly 90. Instead, the blowback prevention assembly 90 inhibits blowback and therefore prevents at least some blowback that would not otherwise be prevented but for the existence of the blowback prevention assembly 90.

In some embodiments, the blowback prevention assembly 90 may be disposed at a point where the housing 50 (e.g., the rear panel of the housing 50) is closest to the ground and extend over a leading edge of the housing 50. As such, when the auger blade 30 rotates in a rearward direction the outermost edge of the auger blade 30 may make a slight contact with the blowback prevention assembly 90 or may pass relatively close thereto with a small tolerance between the auger blade 30 and the blowback prevention assembly 90. The longitudinal length of the blowback prevention assembly 90 may therefore lie substantially parallel to the longitudinal length of the auger blade 30 (and therefore also the auger assembly). In other words, the blowback prevention assembly 90 may extend transversely across an underside of the snow removal device 10 substantially between the side panels 22 and forward of the wheels 24. In some embodiments, the wheels 24 may form one attachment point between the ground and the snow removal device 10, and the blowback prevention assembly 90 may form another point of attachment between the snow removal device 10 and the ground.

Figure 2:
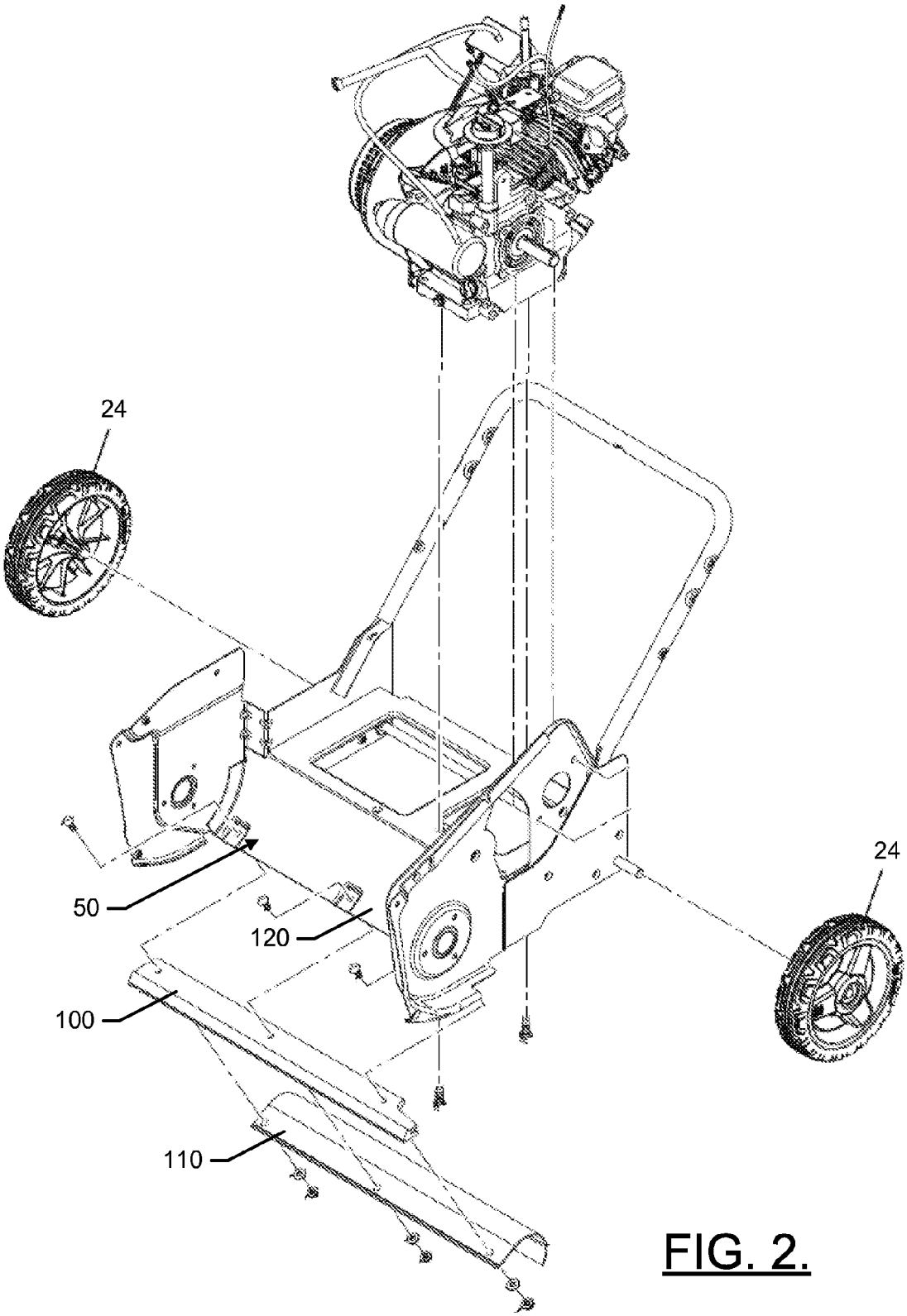
FIG. 2 illustrates an exploded perspective view of some components of the snow removal device including a housing and blowback prevention assembly according to an example embodiment.
Figure 3:
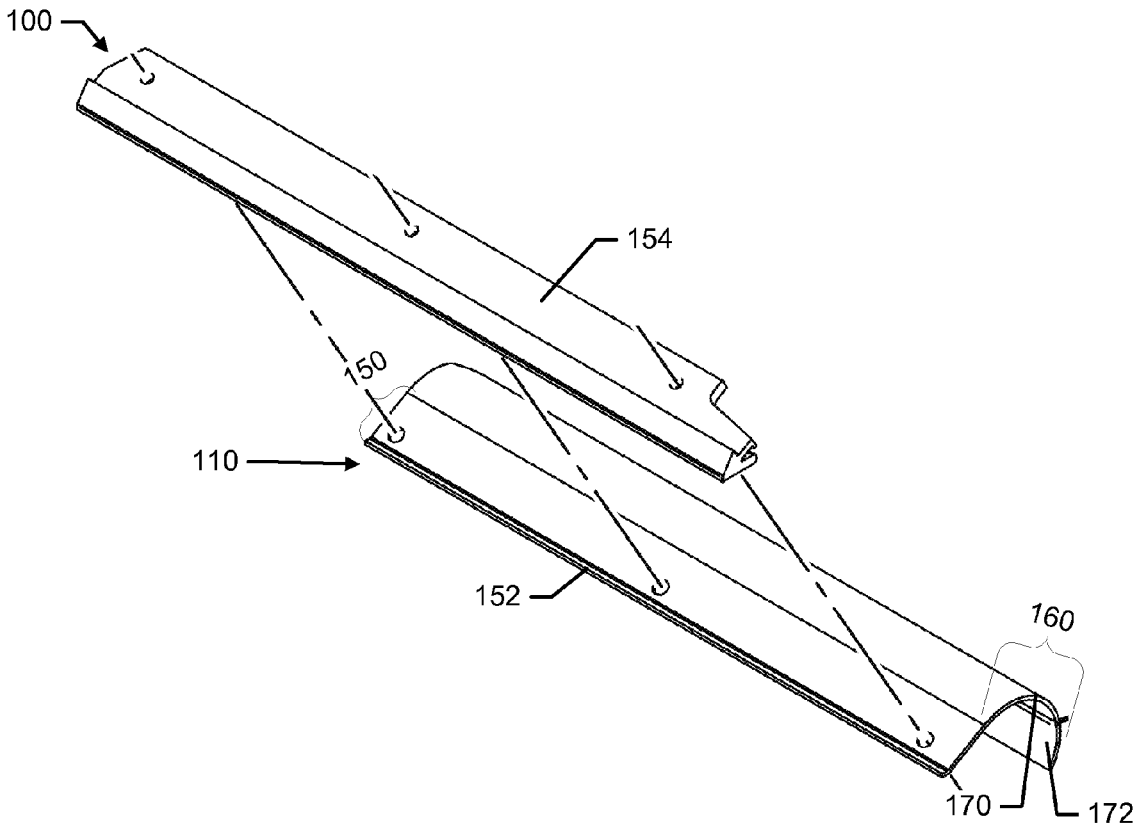
FIG. 3 illustrates a perspective view of a scraper bar and a trailing shield of the blowback prevention assembly in isolation from other components according to an example embodiment.
Figure 4:
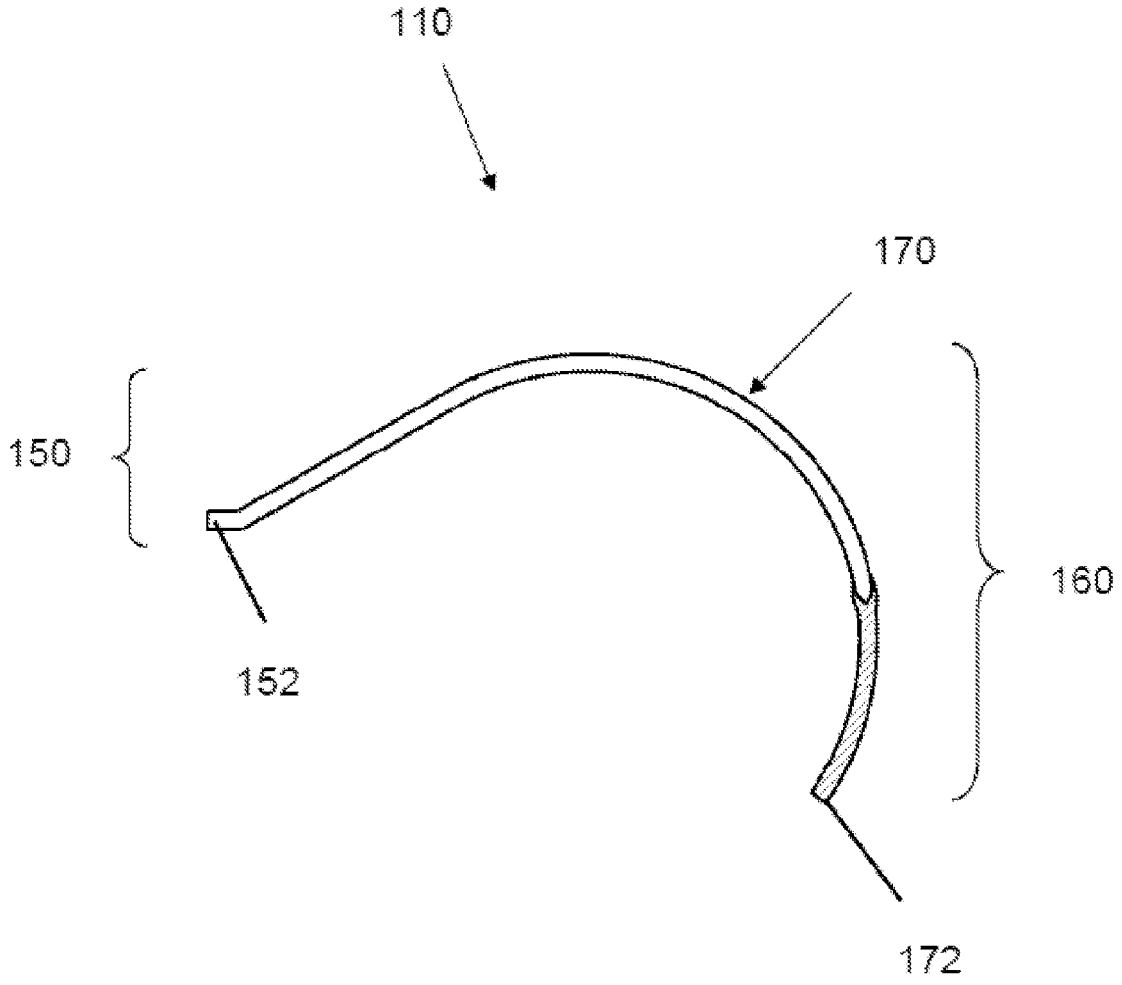
FIG. 4 illustrates a cross sectional view of the blowback prevention assembly according to an example embodiment.

FIG. 2 illustrates an exploded perspective view of the housing 50 and the blowback prevention assembly 90 and FIG. 3 illustrates a perspective view of the components of the blowback prevention assembly 90 in isolation from some other components. FIG. 4 illustrates a side view of the blowback prevention assembly 90 according to an example embodiment.

Referring now to FIGS. 1-4, the blowback prevention assembly 90 may include a scraper bar 100 and a trailing shield 110. The scraper bar 100 may be a unitary piece of rigid material (e.g., hard plastic or metal) that is disposed transversely with respect to a bottom portion of the snow removal device 10 between the side panels 22 thereof. Thus, for example, the scraper bar 100 may extend between opposing sides of the snow removal device 10 substantially parallel to a longitudinal axis of the auger assembly and may be attached to a bottom portion of the housing 50 (e.g., where rear wall 120 of the housing 50 terminates proximate to the ground). The scraper bar 100 may be disposed substantially below at least a portion of the auger assembly and forward of the mobility assembly of the snow removal device 10. In an example embodiment, the scraper bar 100 may be disposed such that the auger blade 30 passes proximate thereto as the auger blade 30 rotates to push material toward the housing 50 (or more specifically toward the rear wall 120 of the housing 50). The auger blade 30 may extend substantially transversely with respect to a front portion of the snow removal device 10 and rotate to provide momentum to the snow as it is pushed over the scraper bar 100, toward the rear wall 120 of the housing 50 and into the ejection path prior to being ejected through the discharge chute 40. In some cases, the auger blade 30 may make contact with the scraper bar 100 as the auger blade 30 rotates. However, in other cases, a small spacing may be maintained therebetween.

Generally speaking, the scraper bar 100 may be provided as a point of contact between the ground and the snow removal device 10. The scraper bar 100 may be a substantially elongated and flat piece of material used to direct snow proximate to the ground into the housing 50. In some cases, the scraper bar 100 may have a tapered leading edge that facilitates scooping snow above the tapered leading edge into the housing 50. As such, the scraper bar 100 may pass over the ground in close proximity thereto, or even in contact therewith in some instances. However, given that the scraper bar 100 is made from a rigid material, any uneven, rough, or broken characteristics to the surface over which the snow removal device 10 travels may create spaces through which snow may pass. Thus, to the extent that the scraper bar 100 were to provide the only mechanism for inhibiting blowback, the scraper bar 100 may allow some blowback, especially in areas where there is not a smooth ground surface.

To provide assistance to the scraper bar 100 with respect to inhibiting blowback, the trailing shield 110 may have an enhanced ability to maintain contact with the ground, even when the ground is uneven, rough or broken. In this regard, the trailing shield 110 may be structured such that at least a portion thereof is flexible to enable better maintenance of contact between the trailing shield 110 and the ground than would be possible for a rigid member only (e.g., the scraper bar 100). In an example embodiment, the trailing shield 110 may include an attachment portion 150 and a skirt 160. The attachment portion 150 may be used to operably connect the trailing shield 110 to the scraper bar 100. In this regard, for example, the attachment portion 150 may be held affixed or otherwise proximate to the scraper bar 100 over an entirety or at least a substantial portion of the corresponding lengths thereof. More specifically, a leading edge 152 of the attachment portion 150 may be held proximate to an attachment surface 154 of the scraper bar 100. In some cases, a longitudinal length of the scraper bar 100 extends parallel to a longitudinal length of the trailing shield 110, and a portion of the trailing shield 110 (e.g., the attachment portion 150) may be affixed to a corresponding portion (e.g., the attachment surface 154) of the scraper bar 100. In one example embodiment, one side of the attachment surface 154 may be in contact with the attachment portion 150 and an opposite side of the attachment surface 154 may be in contact with a bottom portion of the rear wall 120 of the housing 50. In some alternative embodiments, the attachment portion 150 of the trailing shield 110 may actually be disposed between (e.g., sandwiched or trapped between) the attachment surface 154 and the bottom portion of the rear wall 120 of the housing 50. The attachment portion 150 may be affixed to the scraper bar 100 using suitable a connecting agent such as glue, rivets, screws, nut/bolt combinations, or other methods of adhesion. For example, a mechanical joint where a portion of the attachment portion 150 slides, is pressed into, or otherwise fits into a receiving portion along a longitudinal length of the attachment surface 154, or a dove-tail joint may also be employed. Furthermore, welding through friction or ultrasonic welding may also be employed. Moreover, one set of connecting agents may be used to pass through the attachment surface 154, the attachment portion 150 and the bottom portion of the rear wall 120 to connect the scraper bar 100 to both the housing 50 and the trailing shield 110. The attachment portion 150 may then extend substantially rearward relative to a front of the snow removal device toward the skirt 160.

In one alternative embodiment, the scraper bar 100 and the trailing shield 110 may be coextruded as a single unitary piece. In such an example, no additional joints or joining methods would be necessary for connecting the scraper bar 100 to the trailing shield 110 and thus, an example embodiment could be produced with even fewer parts. Coextruding the scraper bar 100 and the trailing shield 110 may include the simultaneous extrusion of three materials (e.g., one for the scraper bar 100, one for the attachment portion 150 and one for the skirt 160) so that each material may have corresponding advantageous properties associated therewith.

The skirt 160 may include an arcuate curve 170 that bends the skirt 160 from the attachment portion 150 to an end portion 172 of the skirt 160 such that the skirt 160 is directed at least partially toward the surface (or ground). Moreover, in some cases, the arcuate curve may bend the skirt 160 toward the surface and at least partially toward the front of the snow removal device 10 as shown in FIG. 4. Thus, in some cases, the arcuate curve 170 may form the trailing shield 110 into a hook shape. In some embodiments, the attachment portion 150 may be made of a rigid material to facilitate engagement with the scraper bar 100, and at least a portion (e.g., the end portion 172) of the skirt 160 may be made from an elastomer in order to provide flexibility. The elastomer may be selected to have hardness measurable by a durometer in a range between 70 A and 90 A on the Shore type A scale. In some cases, the skirt 160 and the attachment portion 150 may be coextruded as a single component. However, in other example embodiments, the skirt 160 (or at least the elastomeric portion of the skirt 160) may be coupled to the attachment portion 150 (or the rigid portion of the skirt 160) using glue, rivets, screws, or other methods of adhesion.

The orientation of the trailing shield 110 such that arcuate bend 170 curves the skirt 160 toward the ground tends to enable the skirt 160 to be preloaded in its normal operating position to apply a force to toward the ground. Moreover, if the end portion 172 were merely angled back toward the rear of the snow removal device 10, less force would be required to get the trailing edge 172 to lift responsive to the momentum of snow striking the skirt 160 and permit blowback than that which would be required to lift the skirt 160 in a situation where the skirt 160 bends down toward the ground or even slightly forward (as shown in FIG. 4). Thus, the skirt 160 may provide a linear contact zone that has improved ability to maintain contact with the ground due to the flexible nature of the skirt 160. As such, there may be up to three contact points for the snow removal device 10 with the ground. The first point may be the mobility assembly (e.g., wheels 24) and the second point may be the scraper bar 100. However, the third point may be a relatively continuous linear contact point provided by the skirt 160 of the trailing shield 110.

Using two materials for the trailing shield 110 may enable a substantial portion of the trailing shield 110 to be manufactured from a relatively low cost material (e.g., a rigid plastic or metal), while only a relatively small portion of the trailing shield 110 (e.g., the skirt 160) may be made from a more expensive elastomer material. Thus, the effectiveness with respect to inhibition of blowback that the elastomeric skirt may provide may be provided with reduced cost. Moreover, by coextruding the attachment portion and the elastomeric skirt at the same time, less components (e.g., no adhesion related components) may be required to further reduce cost and complexity.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A snow removal device comprising:

an auger assembly comprising a rotatable auger that imparts momentum to draw material engaged by the auger toward an ejection path, the auger extending substantially transversely with respect to a front portion of the snow removal device;

a mobility assembly configured to enable the snow removal device to move with respect to a surface;

a housing disposed proximate to a portion of the auger assembly to direct at least some of the material toward the ejection path responsive to rotation of the auger; and a blowback prevention assembly disposed to inhibit blowback of material between the housing and the surface, the blowback prevention assembly comprising a scraper bar and a trailing shield, the scraper bar being an elongated, flat and unitary piece of material disposed transversely with respect to a bottom portion of the snow removal device and proximate to the housing and the auger assembly, the trailing shield disposed proximate to the scraper bar and rearward of the scraper bar, wherein a longitudinal length of the scraper bar extends parallel to a longitudinal length of the trailing shield, and a portion of the trailing shield is affixed to the scraper bar, wherein the trailing shield comprises a substantially flat attachment portion and a skirt, the attachment portion continuously overlapping with the scraper bar over substantially a full length and width of one of the scraper bar or the attachment portion while directly attaching the trailing shield to the scraper bar and extending substantially rearward relative to a front of the snow-removal device, the skirt comprising an arcuate curve that bends the skirt at least partially toward the surface, wherein the skirt defines a continuous substantially linear contact point with the surface along a longitudinal length of the skirt, and wherein the skirt has flexibility along the continuous substantially linear contact point and the scraper bar is rigid.

2. The snow removal device of claim 1, wherein the blowback prevention assembly extends between opposing sides of the snow removal device substantially parallel to a longitudinal axis of the auger assembly.

3. The snow removal device of claim 2, wherein the blowback prevention assembly is disposed substantially below a portion of the auger assembly and forward of the mobility assembly.

4. The snow removal device of claim 1, wherein the scraper bar is disposed to lie proximate to the surface during operation of the snow removal device and direct material over a portion of the scraper bar toward the housing and into the ejection path.

5. The snow removal device of claim 1, wherein the snow removal device is a single stage or dual stage snow removal device.

6. The snow removal device of claim 1, wherein the attachment portion of the trailing shield directly attaches to an attachment surface of the scraper bar, the attachment surface defining a contact plane that is substantially parallel to the surface.

7. A snow removal device comprising:

an auger assembly comprising a rotatable auger that imparts momentum to draw material engaged by the auger toward an ejection path, the auger extending substantially transversely with respect to a front portion of the snow removal device;

a mobility assembly configured to enable the snow removal device to move with respect to a surface;

a housing disposed proximate to a portion of the auger assembly to direct at least some of the material toward the ejection path responsive to rotation of the auger; and a blowback prevention assembly disposed to inhibit blowback of material between the housing and the surface, the blowback prevention assembly comprising a scraper bar and a trailing shield, the scraper bar being an elongated, flat and unitary piece of material disposed transversely with respect to a bottom portion of the snow removal device and proximate to the housing and the auger assembly, the trailing shield disposed proximate to the scraper bar and rearward of the scraper bar, wherein a longitudinal length of the scraper bar extends parallel to a longitudinal length of the trailing shield, and a portion of the trailing shield is affixed to the scraper bar, wherein the trailing shield comprises a substantially flat attachment portion and a skirt, the attachment portion continuously overlapping with the scraper bar over substantially a full length and width of one of the scraper bar or the attachment portion while directly attaching the trailing shield to the scraper bar and extending substantially rearward relative to a front of the snow-removal device, the skirt comprising an arcuate curve that bends the skirt toward the surface and at least partially toward the front of the snow removal device, wherein the skirt defines a continuous substantially linear contact point with the surface along a longitudinal length of the skirt, and wherein the skirt has flexibility along the continuous substantially linear contact point and the scraper bar is rigid.

8. A snow removal device comprising:

an auger assembly comprising a rotatable auger that imparts momentum to draw material engaged by the auger toward an ejection path, the auger extending substantially transversely with respect to a front portion of the snow removal device;

a mobility assembly configured to enable the snow removal device to move with respect to a surface;

a housing disposed proximate to a portion of the auger assembly to direct at least some of the material toward the ejection path responsive to rotation of the auger; and a blowback prevention assembly disposed to inhibit blowback of material between the housing and the surface, the blowback prevention assembly comprising a scraper bar and a trailing shield, the scraper bar being an elongated, flat and unitary piece of material disposed transversely with respect to a bottom portion of the snow removal device and proximate to the housing and the auger assembly, the trailing shield disposed proximate to the scraper bar and rearward of the scraper bar, wherein a longitudinal length of the scraper bar extends parallel to a longitudinal length of the trailing shield, and a portion of the trailing shield is directly affixed to the scraper bar, wherein the trailing shield comprises a substantially flat attachment portion and a skirt, the attachment portion comprising a rigid material and the skirt comprising an elastomer, the attachment portion continuously overlapping with the scraper bar over substantially a full length and width of one of the scraper bar or the attachment portion while directly attaching the trailing shield to the scraper bar and extending substantially rearward relative to a front of the snow removal device, wherein the skirt defines a continuous substantially linear contact point with the surface along a longitudinal length of the skirt, and wherein the skirt has flexibility along the continuous substantially linear contact point and the scraper bar is rigid.

9. The snow removal device of claim 8, wherein the attachment portion and the skirt are coextruded as a single component or are extruded as separate components and affixed to each other.

10. The snow removal device of claim 8, wherein the skirt has a hardness measurable by a durometer in a range between 70 A and 90 A on the Shore type A scale.

11. The snow removal device of claim 8, wherein the scraper bar, the attachment portion and the skirt are coextruded as a single component.

12. A blowback prevention assembly for inhibiting blowback on a snow removal device, the blowback prevention assembly comprising:

a scraper bar comprising an elongated, flat and unitary piece of material disposed transversely with respect to a bottom portion of the snow removal device and proximate to an auger assembly and housing of the snow removal device, the auger assembly comprising a rotatable auger that imparts momentum to draw material engaged by the auger toward an ejection path of the snow removal device, the auger extending substantially transversely with respect to a front portion of the snow removal device, the housing disposed proximate to a portion of the auger assembly to direct at least some of the material toward the ejection path responsive to rotation of the auger; and a trailing shield disposed proximate to the scraper bar and rearward of the scraper bar, wherein a longitudinal length of the scraper bar extends parallel to a longitudinal length of the trailing shield, and a portion of the trailing shield is affixed to the scraper bar, wherein the trailing shield comprises a substantially flat attachment portion and a skirt, the attachment portion continuously overlapping with the scraper bar over substantially a full length and width of one of the scraper bar or the attachment portion while directly attaching the trailing shield to the scraper bar and extending substantially rearward relative to a front of the snow removal device, the skirt comprising an arcuate curve that bends the skirt at least partially toward the surface, wherein the skirt defines a continuous substantially linear contact point with the surface along a longitudinal length of the skirt, and wherein the skirt has flexibility along the continuous substantially linear contact point and the scraper bar is rigid.

13. The blowback prevention assembly of claim 12, wherein the scraper bar extends between opposing sides of the snow removal device substantially parallel to a longitudinal axis of the auger assembly.

14. The blowback prevention assembly of claim 13, wherein the scraper bar is disposed substantially below a portion of the auger assembly and forward of a mobility assembly of the snow removal device.

15. The blowback prevention assembly of claim 12, wherein the scraper bar is disposed to lie proximate to a surface on which the snow removal device operates, and wherein the scraper bar directs material over a portion of the scraper bar toward the housing and into the ejection path.

16. A blowback prevention assembly for inhibiting blowback on a snow removal device, the blowback prevention assembly comprising:

a scraper bar comprising an elongated, flat and unitary piece of material disposed transversely with respect to a bottom portion of the snow removal device and proximate to an auger assembly and housing of the snow removal device, the auger assembly comprising a rotatable auger that imparts momentum to draw material engaged by the auger toward an ejection path of the snow removal device, the auger extending substantially transversely with respect to a front portion of the snow removal device, the housing disposed proximate to a portion of the auger assembly to direct at least some of the material toward the ejection path responsive to rotation of the auger; and a trailing shield disposed proximate to the scraper bar and rearward of the scraper bar, wherein a longitudinal length of the scraper bar extends parallel to a longitudinal length of the trailing shield, and a portion of the trailing shield is affixed to the scraper bar, wherein the trailing shield comprises a substantially flat attachment portion and a skirt, the attachment portion continuously overlapping with the scraper bar over substantially a full length and width of one of the scraper bar or the attachment portion while directly attaching the trailing shield to the scraper bar and extending substantially rearward relative to a front of the snow removal device, the skirt comprising an arcuate curve that bends the skirt toward the surface and at least partially toward the front of the snow removal device, wherein the skirt defines a continuous substantially linear contact point with the surface along a longitudinal length of the skirt, and wherein the skirt has flexibility along the continuous substantially linear contact point and the scraper bar is rigid.

17. A blowback prevention assembly for inhibiting blowback on a snow removal device, the blowback prevention assembly comprising:

a scraper bar comprising an elongated, flat and unitary piece of material disposed transversely with respect to a bottom portion of the snow removal device and proximate to an auger assembly and housing of the snow removal device, the auger assembly comprising a rotatable auger that imparts momentum to draw material engaged by the auger toward an ejection path of the snow removal device, the auger extending substantially transversely with respect to a front portion of the snow removal device, the housing disposed proximate to a portion of the auger assembly to direct at least some of the material toward the ejection path responsive to rotation of the auger; and a trailing shield disposed proximate to the scraper bar and rearward of the scraper bar, wherein a longitudinal length of the scraper bar extends parallel to a longitudinal length of the trailing shield, and a portion of the trailing shield is directly affixed to the scraper bar, wherein the trailing shield comprises a substantially flat attachment portion and a skirt, the attachment portion comprising a rigid material and the skirt comprising an elastomer, the attachment portion continuously overlapping with the scraper bar over substantially a full length and width of one of the scraper bar or the attachment portion while directly attaching the trailing shield to the scraper bar and extending substantially rearward relative to a front of the snow removal device, wherein the skirt defines a continuous substantially linear contact point with the surface along a longitudinal length of the skirt, and wherein the skirt has flexibility along the continuous substantially linear contact point and the scraper bar is rigid.

18. The blowback prevention assembly of claim 17, wherein the attachment portion and the skirt are coextruded as a single component or are extruded as separate components and affixed to each other.

19. The blowback prevention assembly of claim 17, wherein the scraper bar, the attachment portion and the skirt are coextruded as a single component.

20. The blowback prevention assembly of claim 17, wherein the skirt has a hardness measurable by a durometer in a range between 70 A and 90 A on the Shore type A scale.

* * * * *